US007793491B2

(12) United States Patent
Esaka

(10) Patent No.: US 7,793,491 B2
(45) Date of Patent: Sep. 14, 2010

(54) EXHAUST EMISSION PURIFYING APPARATUS FOR ENGINE

(75) Inventor: Takehiro Esaka, Ageo (JP)

(73) Assignee: Nissan Diesel Motor Co., Ltd., Ageo-shi, Saitama (JP)

( * ) Notice: Subject to any disclaimer, the term of this patent is extended or adjusted under 35 U.S.C. 154(b) by 465 days.

(21) Appl. No.: 12/015,998

(22) Filed: Jan. 17, 2008

(65) Prior Publication Data

US 2008/0110158 A1 May 15, 2008

Related U.S. Application Data

(63) Continuation of application No. PCT/JP2006/310549, filed on May 26, 2006.

(30) Foreign Application Priority Data

Aug. 24, 2005 (JP) ..... 2005-242141

(51) Int. Cl.
*F01N 3/00* (2006.01)

(52) U.S. Cl. ..... 60/286; 60/276; 60/295; 60/301; 60/303

(58) Field of Classification Search ..... 60/276, 60/277, 285, 286, 295, 301, 303
See application file for complete search history.

(56) References Cited

U.S. PATENT DOCUMENTS

| | | | | |
|---|---|---|---|---|
| 5,186,148 | A * | 2/1993 | Wataya | 123/479 |
| 6,119,448 | A * | 9/2000 | Emmerling et al. | 60/274 |
| 6,487,852 | B1 * | 12/2002 | Murphy et al. | 60/286 |
| 7,685,810 | B2 * | 3/2010 | Hirata et al. | 60/277 |
| 2001/0041955 | A1 | 11/2001 | Nada | |
| 2003/0158639 | A1 | 8/2003 | Nada | |

FOREIGN PATENT DOCUMENTS

| | | | |
|---|---|---|---|
| CN | 1332095 | | 1/2002 |
| EP | 1050670 | A2 | 11/2000 |
| EP | 1 153 783 | A2 | 11/2001 |
| EP | 1262644 | A2 | 12/2002 |
| JP | 59-150632 | | 10/1984 |
| JP | 2001-317399 | | 11/2001 |
| JP | 2005-147118 | | 6/2005 |
| JP | 2005155404 | A | 6/2005 |
| JP | 2005-207297 | A | 8/2005 |
| WO | WO 03/036056 | A1 | 5/2003 |
| WO | WO 2005/040569 | A1 | 5/2005 |

* cited by examiner

*Primary Examiner*—Thomas E Denion
*Assistant Examiner*—Diem Tran
(74) *Attorney, Agent, or Firm*—McDermott Will & Emery LLP

(57) ABSTRACT

When concentration of reducing agent stored in reducing agent container deviates from predetermined range or when residual amount of reducing agent becomes equal to or smaller than predetermined amount, it is judged that liquid in reducing agent container is different aqueous solution or reducing agent is deficient (abnormal judgment). Upon restarting of engine operation, if abnormal judgment is made and vehicle's travel for a predetermined distance or more occurs after abnormal judgment, restarting of engine operation is inhibited. At this time, if elapsed time until restarting of engine operation is performed from stopping moment of engine operation is less than predetermined time, engine operation is judged to be unintentionally stopped, and restarting of engine operation is permitted enabling a prompt action in emergency. But, even when abnormal judgment is made, if vehicle travels a distance less than predetermined distance after abnormal judgment, restarting of engine operation is permitted enabling vehicle to travel to reducing agent replenishing point.

8 Claims, 6 Drawing Sheets

EXHAUST EMISSION PURIFYING APPARATUS FOR ENGINE

This application is a continuation of PCT/JP2006/310549, filed on May 26, 2006.

BACKGROUND OF THE INVENTION

1. Field of the Invention

The present invention relates to an apparatus for purifying exhaust emission from an engine (to be referred to as an exhaust emission purifying apparatus), and in particular, to a technology for reductively purifying nitrogen oxides ($NO_x$) in the exhaust emission using a reducing agent.

2. Description of the Related Art

As a catalytic purification system for removing NOx contained in the exhaust emission of an engine, there has been typically proposed, in Japanese Laid-open (Kokai) Patent Application Publication No. 2005-147118, an exhaust emission purifying apparatus in which a reducing agent or precursor thereof is dosed according to engine operating conditions to the exhaust emission streaming upstream of a reduction catalytic converter disposed in an engine exhaust pipe, so that $NO_x$ in the exhaust emission and the reducing agent are subjected to the catalytic-reduction reaction, to thereby purify $NO_x$ into harmless components. In this conventional exhaust emission purifying apparatus, in order to promote the use of a normal reducing agent, i.e., a precisely operative reducing agent, a configuration is adopted such that if use of any different kind of aqueous solution or the deficiency of the reducing agent is detected during engine operation and thereafter, once the engine operation is stopped by using an ignition switch, the restart of the engine operation is inhibited any more.

Nevertheless, if the restart of the engine operation is inhibited due to the reducing agent deficiency, for example when the reducing agent becomes deficient immediately before the engine-operated vehicle reaches its destination, it is required for the vehicle to unload cargo and to continue running by keeping the engine operation to a location where the reducing agent may be replenished. In a case where the location at which the reducing agent can be replenished is not so near, an excessive burden is imposed on a vehicle driver and also a fuel is unnecessarily consumed due to the vehicle running irrelevant to the physical distribution. Further, if the vehicle driver did wish to take a rest in a state where the reducing agent is deficient, the drive must refrain stopping of the engine operation. Still further, such a situation is not preferable in view of the global environment.

SUMMARY OF THE INVENTION

Therefore, in view of the problems encountered by the conventional technology as described above, the present invention has an object to provide an exhaust emission purifying apparatus in which, even if a use of the different kind of aqueous solution or the deficiency of a reducing agent is detected, restarting of an engine operation is permitted after stopping thereof until a vehicle mounting thereon the engine travels or runs for a predetermined distance after the detection, to thereby prevent an increase of a vehicle driver's burden, the unnecessary fuel consumption and the like.

In order to achieve the above-mentioned object, an exhaust emission purifying apparatus according to the present invention comprises: a reduction catalytic converter that is disposed in an engine exhaust pipe for reductively purifying nitrogen oxides in the exhaust emission by using a reducing agent supplied from a reducing agent container; a concentration sensor that detects a concentration of the reducing agent stored in the reducing agent container; a residual amount sensor that detects that a residual amount of the reducing agent stored in the reducing agent container becomes equal to or smaller than a predetermined amount; and a control unit incorporating therein a computer, wherein the control unit is configured to execute:

a reducing agent judging process of judging that a liquid in the reducing agent container is any different kind of aqueous solution or that the reducing agent is deficient when the concentration of the reducing agent detected by the concentration sensor deviates from a predetermined range or when it is detected by the residual amount sensor that a residual amount becomes equal to or smaller than a predetermined amount; and an engine control process of inhibiting restarting of an engine operation even if the restarting of the engine operation is performed, when such an initial judgment is made by the reducing agent judging process that the liquid in the reducing agent container is the different kind of aqueous solution or the reducing agent is deficient and also when such a subsequent judgment is made that a traveling distance of a vehicle driven by the engine after the initial judgment is equal to or longer than a predetermined distance, while permitting the restarting of the engine operation for rest conditions except for a condition of combination of the initial and subsequent judgments.

By virtue of the exhaust emission purifying apparatus according to the present invention, it is judged that the liquid in the reducing agent container is the different kind of aqueous solution or that the reducing agent is deficient when the concentration of the reducing agent stored in the reducing agent container deviates from the predetermined range or when the residual amount of the reducing agent stored in reducing agent container becomes equal to or smaller than the predetermined amount. Then, when the restarting of the engine operation is made, the engine operation is inhibited from restarting when it is judged that the liquid in the reducing agent container is the different kind of aqueous solution or the reducing agent is deficient and also when the traveling distance of a vehicle after the judgment is judged to be equal to or longer than the predetermined distance, while the restarting of the engine operation is permitted for the rest conditions except for a condition of combination of the above-mentioned twice judgings. Therefore, even when it is detected that the liquid in the reducing agent container is the different kind of aqueous solution or the reducing agent is deficient, the inhibition of the restarting of the engine operation is suspended during a period of time until the vehicle travels for the predetermined distance after the above-mentioned detection. Accordingly, for example, even when the reducing agent becomes deficient immediately before reaching the destination of the vehicle, a driver of the vehicle is not forced to drive the vehicle to a point at which the reducing agent can be replenished after reaching the destination, and therefore, an increase of driver's burden can be prevented. Further, since the vehicle driving or the idling for the reducing agent replenishment is prevented, it is possible to achieve the prevention of the unnecessary fuel consumption and the protection of global environment.

DESCRIPTION OF THE PREFERRED EMBODIMENTS

Details of the present invention will be described hereunder, referring to the accompanying drawings.

Figure 1:
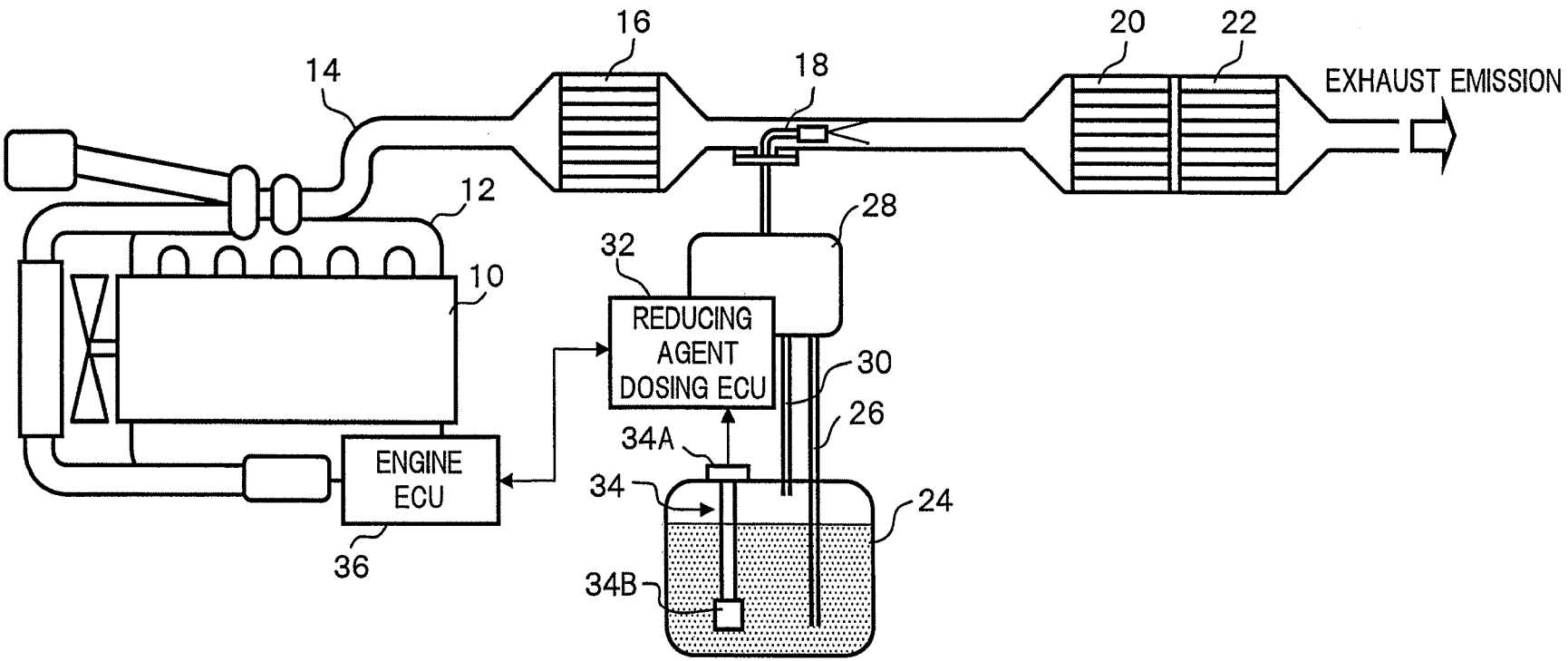
FIG. 1 is an entire block diagram of an exhaust emission purifying apparatus according to the present invention.

FIG. 1 shows an entire configuration of an exhaust emission purifying apparatus for using the urea aqueous solution which is precursor of ammonia, which is used as a reducing agent, to purify $NO_x$ contained in the engine emission by catalytic reduction reaction.

In an exhaust pipe 14 connected to an exhaust manifold 12 of an engine 10, there are disposed, along an exhaust emission flow direction in this order, a nitrogen oxidation catalytic converter 16 which oxidizes nitrogen monoxide (NO) into nitrogen dioxide ($NO_2$), an injection nozzle 18 which injection-supplies the urea aqueous solution, a $NO_x$ reduction catalytic converter 20 which reductively purifies $NO_x$ with ammonia obtained by hydrolyzing the urea aqueous solution, and an ammonia oxidation catalytic converter 22 which oxidizes ammonia passed through the $NO_x$ reduction catalytic converter 20. Further, the urea aqueous solution stored in a reducing agent container 24 is supplied to a reducing agent dosing device 28 via supply piping 26 having a suction port thereof positioned on a bottom portion of the reducing agent container 24. On the other hand, the surplus urea aqueous solution which did not contribute to the injection in the urea aqueous solution supplied to the reducing agent dosing device 28 is returned to the reducing agent container 24 via return piping 30 having a liquid return port opened at an upper portion of the reducing agent container 24. Then, the reducing agent dosing device 28 is electronically controlled by a reducing agent dosing control unit (to be referred to as reducing agent dosing ECU hereunder) 32 incorporating therein a computer, to supply the urea aqueous solution of which a flow amount is controlled according to engine operating conditions, to the injection nozzle 18, in an atomized state mixed with compressed air.

In such an exhaust emission purifying apparatus, the urea aqueous solution injection-supplied from the injection nozzle 18 is hydrolyzed with the exhaust heat and the water vapor in the exhaust emission to be converted into ammonia. It is known that converted ammonia reductively reacts with $NO_x$ contained in the exhaust emission in the $NO_x$ reduction catalytic converter 20 and is converted into water ($H_2O$) and nitrogen ($N_2$). At this time, in order to improve the $NO_x$ purification efficiency in the $NO_x$ reduction catalytic converter 20, NO is oxidized into $NO_2$ by the nitrogen oxidation catalytic converter 16, so that a rate between NO in the exhaust emission and $NO_2$ therein is improved to be suitable for the catalytic-reduction reaction. On the other hand, ammonia passed through the $NO_x$ reduction catalytic converter 20 is oxidized by the ammonia oxidation catalytic converter 22 disposed on the downstream side of the $NO_x$ reduction catalytic converter 20 in the exhaust passageway, and therefore, it is possible to prevent ammonia from being discharged into the atmosphere just as it is.

Further, a concentration sensor 34 which outputs a signal relating to the concentration of the urea aqueous solution is mounted on the reducing agent container 24. Namely, a base portion 34A incorporating therein a circuit substrate is fixed on a ceiling of the reducing agent container 24, and also, a detecting portion 34B is suspended from the base portion 34A toward the bottom portion of the reducing agent container 24.

Figure 2:
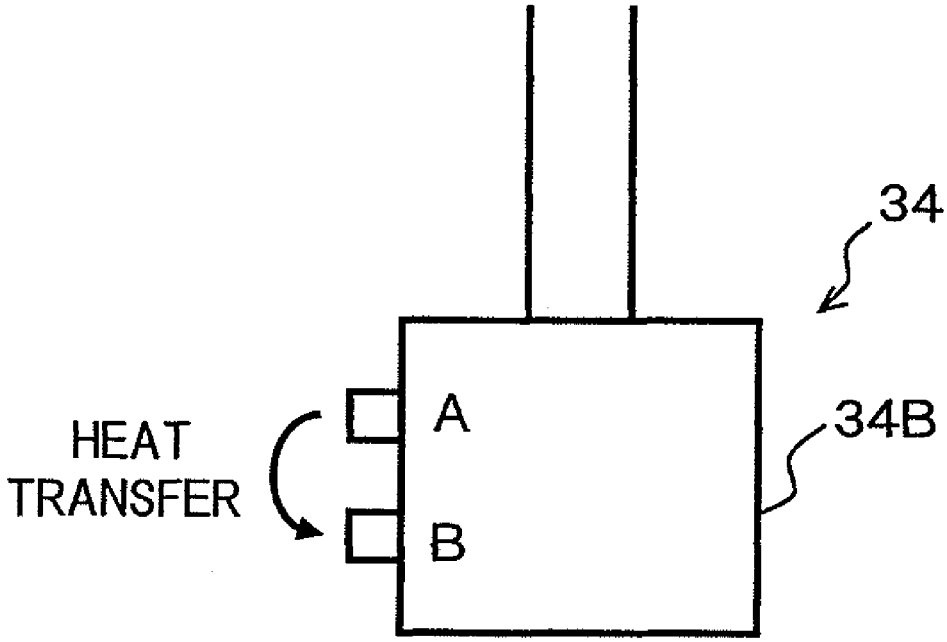
FIG. 2 is a detail diagram of a detecting portion of a concentration sensor.
Figure 3:
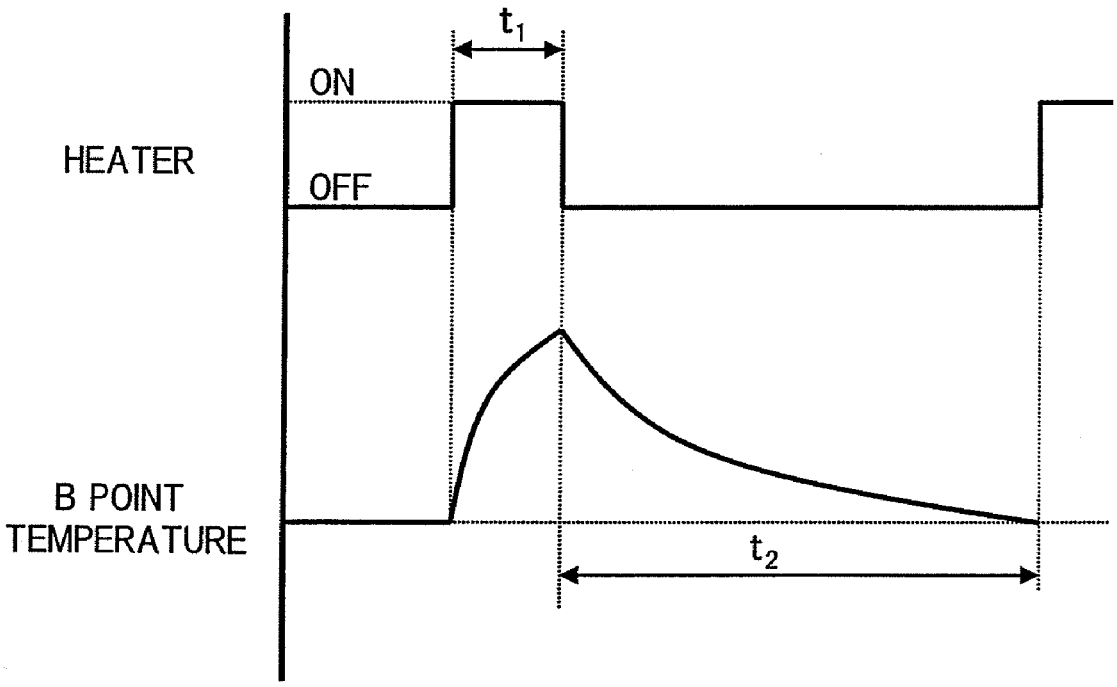
FIG. 3 is an explanatory diagram of a concentration detection principle of the concentration sensor.

Here, as shown in FIG. 2, as the detecting portion 34B, a heater A and a temperature sensor B are disposed on two positions separated apart from each other. Then, when the heater A is operated, the signal relating to the concentration of the urea aqueous solution is outputted from the circuit substrate incorporated in the base portion 34A via thermal characteristics in which the heat from the heater A is transferred to the temperature sensor B. To be specific, as shown in FIG. 3, when the heater A is operated for a predetermined time $t_1$, in the temperature sensor B, the temperature gradually goes up with a characteristic according to thermal conductivity of the urea aqueous solution. Then, the concentration of the urea aqueous solution can be indirectly measured according to a rise characteristic of the temperature for a condition where the operation of the heater A is stopped, that is, a difference between the initial temperature in the temperature sensor B and the peak temperature therein. On the other hand, after the operation of the heater A is stopped, the temperature in the temperature sensor B is gradually lowered, and spends a time $t_2$ to return to the temperature before the heater operation. Therefore, the concentration of the urea aqueous solution can be measured at every predetermined time ($t_1$+$t_2$). Incidentally, as the concentration sensor 34, the one manufactured and distributed by Mitsui Mining and Smelting Co., Ltd. in Japan is known.

Here, the concentration sensor 34 is configured to indirectly detect the concentration of the urea aqueous solution based on the heat transfer characteristics between two positions separated apart from each other, and therefore, can also detect that the urea aqueous solution is deficient, that is, the reducing agent container 24 is empty or a residual amount in the reducing agent container 24 becomes less. Therefore, in the present embodiment, since the concentration sensor 34 also has a function as a residual amount sensor, the number of necessary sensors becomes less, and consequently, it is possible to suppress the cost rise and the like.

The output signal from the concentration sensor 34 is inputted to the reducing agent dosing ECU 32. Further, the reducing agent dosing ECU 32 is connected to an engine control unit (to be referred to as engine ECU, hereunder) 36 via CAN (Controller Area Network), and is configured such that an ignition switch signal, a traveling distance signal and the like can be appropriately read. Then, the reducing agent dosing ECU 32 executes each of reducing agent judging process, engine control process, operation stop intention judging process and predetermined temperature setting process, in accordance with a control program stored in a ROM (Read Only Memory) thereof, to appropriately output, to the engine ECU 36, an inhibition signal and a permission signal of the restarting of an engine operation. Incidentally, the ignition switch signal, the traveling distance signal and the like may not be indirectly read from the engine ECU 36, but may be directly read from the switch, the sensor and the like.

Figure 4:
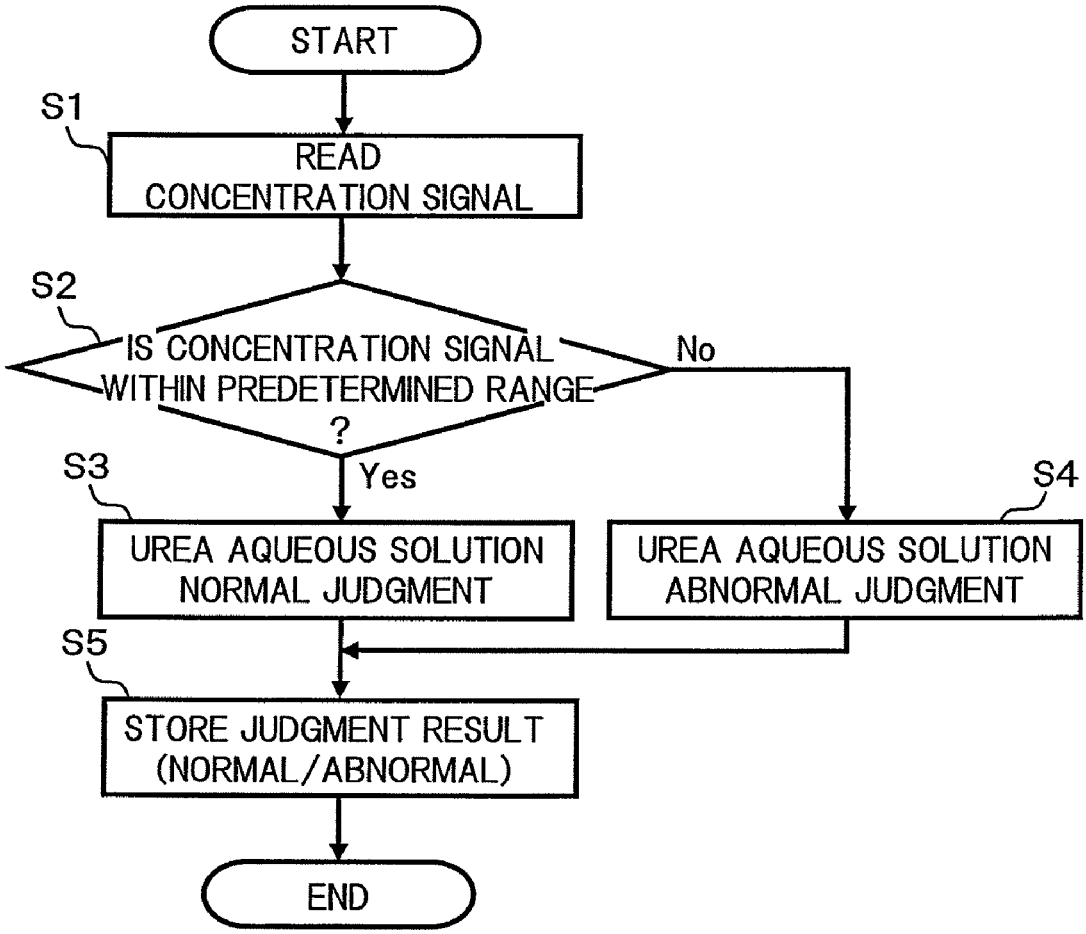
FIG. 4 is a flowchart showing reducing agent judging process.

FIG. 4 shows the reducing agent judging process repetitively executed in the reducing agent dosing ECU 32 at every predetermined time ($t_1$+$t_2$) after start of the engine operation.

In step 1 (to be abbreviated as S1 in the drawing, and the same rule will be applied to the subsequent steps), the concentration signal from the concentration sensor 34 is read. Namely, the heater A in the concentration sensor 34 is operated for the predetermined time $t_1$, and the concentration signal according to the temperature rise characteristic of the temperature sensor B is read.

In step 2, it is judged whether or not the concentration signal is within a predetermined range. Here, the predetermined range is a range of concentration signal that can be occupied provided that the normal urea aqueous solution is filled in the reducing agent container 24, and is appropriately set based on characteristics of the urea aqueous solution, for example. Then, if the concentration signal is within the predetermined range (Yes), the routine proceeds to step 3, while if the concentration signal deviates from the predetermined range (No), the routine proceeds to step 4.

In step 3, it is judged that the urea aqueous solution contained in the reducing agent container 24 is a normal one (normal judgment).

In step 4, it is judged that the liquid contained in the reducing agent container 24 is the different kind of aqueous solution or the urea aqueous solution is deficient in the same container 24 (abnormal judgment). Here, it is supposed that the different kind of aqueous solution is such a urea aqueous solution excessively diluted with water or the like, mere tap water used instead of the urea aqueous solution, or the like. Then, when the abnormal judgment is made, it is desirable that, in order to promote a vehicle driver to replenish the urea aqueous solution or to exchange for the normal urea aqueous solution, a buzzer, a warning lamp or the like is operated to notify the vehicle driver of the abnormal judgment. Note: the process of notifying the abnormal judgment corresponds to notifying process.

In step 5, the judgment result in step 3 or step 4 is stored in a data storage medium such as a memory, in order to enable the reference of the judgment result of the urea aqueous solution as needed.

According to this reducing agent judging process, a state of the urea aqueous solution stored in the reducing agent container 24 is sequentially judged at time intervals according to a detection principle of the concentration sensor 34, and the judgment result is stored in the storage medium. Therefore, it is possible to refer at any time to the state of the urea aqueous solution if necessary, and also, it is possible to detect that the urea aqueous solution becomes deficient during the vehicle traveling.

Figure 5:
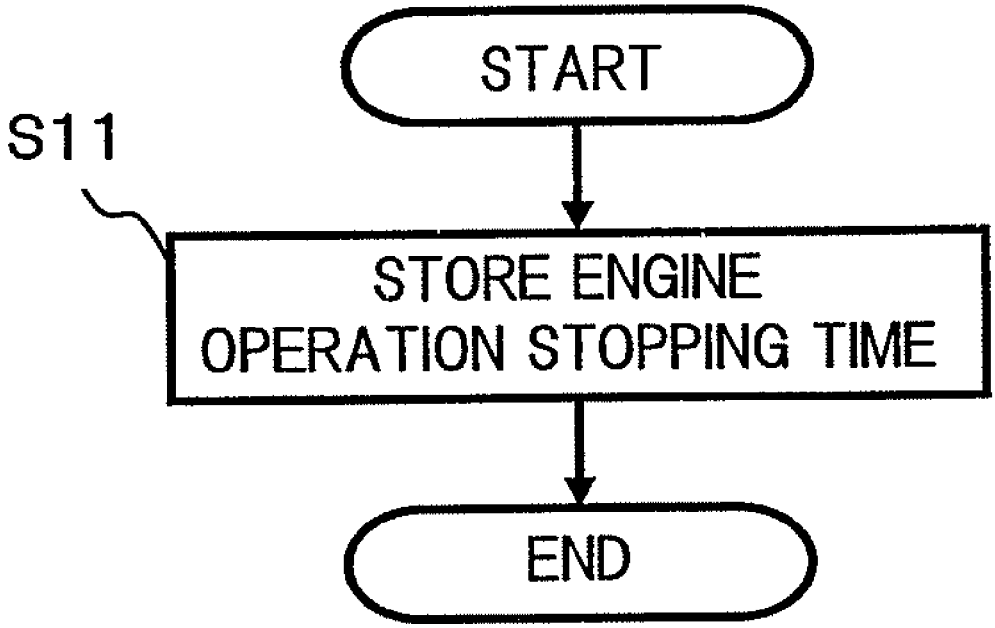
FIG. 5 is a flowchart showing engine operation stopping time storing process.

FIG. 5 shows engine operation stopping time storing process executed by the reducing agent dosing ECU 32, when the operation of the engine 10 is stopped. Here, the engine operation stop does not only mean that the operation of the engine 10 is stopped by an ignition key, but also includes that the operation of the engine 10 is stopped unintentionally due to an inappropriate operation of a clutch, for example.

In step 11, the time when the operation of the engine 10 is stopped is stored in the storage medium. Here, for storing the engine operation stopping time, for example, an output from a clock timer incorporated in the reducing agent dosing ECU 32 or the engine ECU 36 may be used.

According to this engine operation stopping time storing process, the time when the operation of the engine 10 is stopped is stored in the storage medium. Incidentally, as the storage medium, it is desirable to use a nonvolatile memory capable of retaining the stored content even if the power supply to the reducing agent dosing ECU 32 is shutoff.

Figure 6:
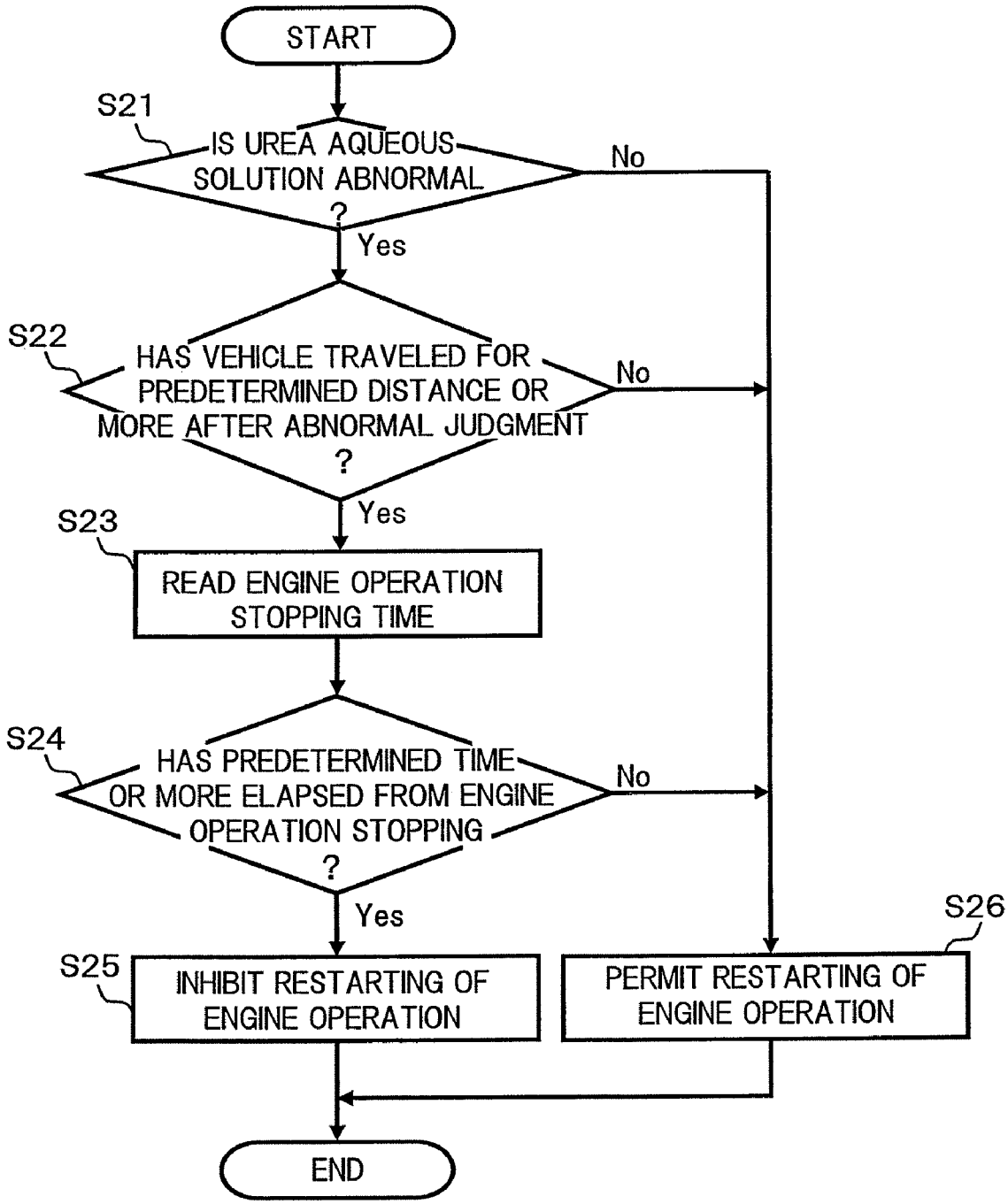
FIG. 6 is a flowchart showing engine operation restart permitting/inhibiting process.

FIG. 6 shows restart permitting/inhibiting process (engine control process) to be executed before the engine operation restarting process by the engine ECU 36, when the ignition key switch is turned ON, that is, the engine operation is restarted.

In step 21, it is judged whether or not the urea aqueous solution judgment result stored in the storage medium is the abnormal judgment. Then, if the judgment result is the abnormal judgment (Yes), the routine proceeds to step 22, while if the judgment result is the normal judgment (No), the routine proceeds to step 26.

In step 22, it is judged whether or not the vehicle has traveled for a predetermined distance or longer from the time when the abnormal judgment was made in the reducing agent judging process. Here, the vehicle traveling distance may be measured by storing in the storage medium a traveling distance that the vehicle ran until the moment when the abnormal judgment is made and by calculating a difference between the stored traveling distance and every traveling distance which is sequentially read in after the abnormal judgment. Then, if the vehicle has traveled for the predetermined distance or longer (Yes), the routine proceeds to step 23, while if the vehicle has not traveled for the predetermined distance or longer (No), the routine proceeds to step 26.

In step 23, the engine operation stopping time is read from the storage medium.

In step 24, it is judged whether or not a time duration equal to or more than a predetermined time has elapsed from the engine operation stopping time, based on the output from the clock timer. Then, if the time duration equal to or more than the predetermined time has elapsed from the engine operation stopping time (Yes), the routine proceeds to step 25, while if equal to or more than the predetermined time has not elapsed from the engine operation stopping time (No), the routine proceeds to step 26. Note: the process in step 24 corresponds to the operation stop intention judging process.

In step 25, an engine operation restart inhibiting signal is outputted to the engine ECU 36.

In step 26, an engine operation restart permitting signal is outputted to the engine ECU 36.

According to this engine restart permitting/inhibiting process, even when the urea aqueous solution judgment result is the abnormal judgment, that is, even if it is judged that the liquid in the reducing agent container 24 is the different kind of aqueous solution or the urea aqueous solution is deficient, the restarting of operation of the engine 10 is permitted during a period until the vehicle travels for the predetermined distance after the abnormal judgment. Therefore, even if the urea aqueous solution stored in the reducing agent container 24 becomes deficient, the engine operation restarting is not inhibited immediately thereafter, and the inhibition of restarting of the engine operation is suspended until the vehicle travels for the predetermined distance. Accordingly, for example even when the reducing agent becomes deficient immediately before reaching the destination, the vehicle driver is not forced to drive the vehicle to a point at which the reducing agent can be replenished after reaching the destination, and therefore, an increase of driver's burden can be prevented. Further, since the vehicle driving or the idling for the reducing agent replenishment is prevented, it is possible to achieve the prevention of the unnecessary fuel consumption and the protection of global environment.

On the other hand, when the vehicle travels for more than the predetermined distance in the state where it is judged that the liquid in the reducing agent container 24 is the different kind of aqueous solution or the urea aqueous solution is deficient, it is judged that although the urea aqueous solution can be replenished or the exchange for the urea aqueous solution can be made, the vehicle driver intentionally does not make the replenishment or the exchange, and in principle, the restarting of operation of the engine 10 is inhibited. Therefore, it becomes possible to promote the vehicle driver to use the normal urea aqueous solution, so that the vehicle driving can be performed in the state where the function as the exhaust emission purifying apparatus is achieved.

Further, even when the vehicle travels for more than the predetermined distance in the state where it is judged that the liquid in the reducing agent container 24 is the different kind of aqueous solution or the urea aqueous solution is deficient, if an elapsed time until the engine operation restarting is made from the time when the engine operation is stopped is less than a predetermined time, it is judged that the engine operation is unintentionally stopped, the operation restarting of the engine 10 is permitted. Therefore, for example, when the operation of the engine 10 is stopped in railroad crossing due to the inappropriate operation of the clutch, since the engine operation restarting is permitted, it is possible to take a prompt action in an emergency.

Incidentally, by using the coolant temperature for indirectly detecting the temperature of the engine 10, whether or not the engine operation is stopped intentionally may be judged based on whether or not a difference between the coolant temperature at the time when the engine operation is stopped and that at the time when the engine operation is restarted is less than a predetermined temperature. Thus, since the engine temperature is indirectly detected by utilizing a water temperature sensor provided in a water-cooled engine, it is possible to suppress the cost rise. At this time, for the coolant temperature after the engine operation stop, a lowering rate (speed) thereof is changed depending on the ambient temperature. Therefore, if the configuration is such that there is disposed an ambient temperature sensor for detecting the ambient temperature and the predetermined temperature is dynamically set according to the detected ambient temperature, the judgment precision can be improved. Here, the process of dynamically setting the predetermined temperature corresponds to the predetermined temperature setting process.

Further, in the present embodiment, the concentration of the urea aqueous solution and the residual amount thereof are detected by the concentration sensor 34. However, for detecting the concentration and the residual amount, a concentration sensor for detecting the concentration of the urea aqueous solution based on another detection principle and a level sensor for detecting the residual amount of the urea aqueous solution may be used. Furthermore, the control of the exhaust emission purifying apparatus may be performed not only by the reducing agent dosing ECU 32 but by the cooperation of the reducing agent dosing ECU 32 and the engine ECU 36. At this time, in the engine ECU 36, the engine operation restarting may be inhibited, by shutting off the fuel supply to the engine 10 or electrically shutting off the power supply to an engine starter, for example.

The present invention can be applied not only to the exhaust emission purifying apparatus using the urea aqueous solution as precursor of ammonia used as the reducing agent, but also to those apparatuses using, as a reducing agent or precursor thereof, the ammonia aqueous solution, and gasoline and diesel oil which contain hydrocarbon as a main component thereof.

It should be appreciated that the entire contents of Japanese Patent Application No. 2005-242141, filed on Aug. 24, 2005, on which the convention priority is claimed is incorporated herein by reference.

It should also be understood that many modifications and variations of the described embodiments of the invention will occur to a person having an ordinary skill in the art without departing from the spirit and scope of the present invention as claimed in the appended claims.

I claim:

1. An exhaust emission purifying apparatus comprising: a reduction catalytic converter that is disposed in an engine exhaust pipe for reductively purifying nitrogen oxides in an exhaust emission using a reducing agent supplied from a reducing agent container; a concentration sensor that detects a concentration of the reducing agent stored in the reducing agent container; a residual amount sensor that detects that a residual amount of the reducing agent stored in the reducing agent container becomes equal to or smaller than a predetermined amount; and a control unit incorporating therein a computer, wherein the control unit executes:

a reducing agent judging process of judging that a liquid in the reducing agent container is any different kind of aqueous solution or that the reducing agent is deficient, when the concentration of the reducing agent detected by the concentration sensor deviates from a predetermined range or when it is detected by the residual amount sensor that a residual amount becomes equal to or smaller than a predetermined amount; and an engine control process of inhibiting restarting of an engine operation even when the restarting of an engine operation is performed, when such an initial judgment is made by the reducing agent judging process that the liquid in the reducing agent container is the different kind of aqueous solution or the reducing agent is deficient and also when such a subsequent judgment is made that a traveling distance of a vehicle driven by the engine after the initial judgment is equal to or longer than a predetermined distance, while permitting the restarting of the engine operation for rest conditions except for a condition of combination of the initial and subsequent judgments.

2. The apparatus according to claim 1, wherein the concentration sensor and the residual amount sensor indirectly detect the concentration of the reducing agent and whether or not the residual amount becomes equal to or smaller than the predetermined amount, respectively, based on heat transfer characteristics between two points separated apart from each other at a bottom portion of the reducing agent container.

3. The apparatus according to claim 1, wherein the control unit further executes:

a notifying process of notifying a result of judgment made by the reducing agent judging process when said judging process makes such a judgment that the liquid in the reducing agent container is the different kind of aqueous solution or the reducing agent is deficient.

4. The apparatus according to claim 1, wherein the control unit further executes an operation stop intention judging process of judging whether or not the engine operation is stopped unintentionally, and the engine control process permits the restarting of the engine operation when the operation stop intention judging process judges that the engine operation is stopped unintentionally.

5. The apparatus according to claim 4, wherein the operation stop intention judging process executed by the control unit judges that the engine operation is unintentionally stopped when an elapsed time until the restarting of the engine operation is performed from a time when the engine operation is stopped is less than a predetermined time.

6. The apparatus according to claim 4, wherein the operation stop intention judging process executed by the control unit judges that the engine operation is unintentionally stopped when a difference between an engine temperature detected at a time when the engine operation is stopped and that detected at a time when the restarting of the engine operation is performed is less than a predetermined temperature.

7. The apparatus according to claim 6, wherein the engine temperature is indirectly detected, based on an engine coolant temperature.

8. The apparatus according to claim 6, further comprising an ambient temperature sensor that detects an ambient temperature, wherein the control unit further executes:

a predetermined temperature setting process of dynamically setting the predetermined temperature, based on the ambient temperature detected by the ambient temperature sensor.

* * * * *